US007335830B2

(12) United States Patent
Box et al.

(10) Patent No.: US 7,335,830 B2
(45) Date of Patent: Feb. 26, 2008

(54) METHOD AND DEVICE FOR ATTACHING A MUSICAL INSTRUMENT STRING TO A MUSICAL INSTRUMENT TUNING PEG

(76) Inventors: Kenneth William Box, 1117 W. 9th St., Austin, TX (US) 78703; Thomas McGarrigle, P.O. Box 457, Liberty Hill, TX (US) 78642

( * ) Notice: Subject to any disclaimer, the term of this patent is extended or adjusted under 35 U.S.C. 154(b) by 0 days.

(21) Appl. No.: 11/200,745

(22) Filed: Aug. 10, 2005

(65) Prior Publication Data

US 2006/0048626 A1 Mar. 9, 2006

Related U.S. Application Data

(60) Provisional application No. 60/600,422, filed on Aug. 10, 2004.

(51) Int. Cl.
*G10D 3/14* (2006.01)

(52) U.S. Cl. ..... 84/304; 84/290

(58) Field of Classification Search ..... 84/304, 84/297 R, 312 R, 298, 290; D17/20, 21
See application file for complete search history.

(56) References Cited

U.S. PATENT DOCUMENTS 842,329 A 1/1907 McClean
1,385,837 A 7/1921 Kistner
4,498,366 A 2/1985 Carr
4,589,321 A 5/1986 Pritchard
4,674,387 A * 6/1987 Caruth ..... 84/304
5,265,512 A * 11/1993 Kubicki et al. ..... 84/298
5,372,057 A 12/1994 Hart
5,728,955 A 3/1998 Sperzel

* cited by examiner

*Primary Examiner*—Lincoln Donovan
*Assistant Examiner*—Jianchun Qin
(74) *Attorney, Agent, or Firm*—Gregory K. Goshorn; Greg Goshorn, P.C.

(57) ABSTRACT

Provided is a string tuning mechanism that enables a musician to clamp and anchor a musical instrument string to a musical instrument tuning peg. The claimed subject matter enables the musician to put on and take off the strings of a stringed musical instrument easily and rapidly. The string attachment device also enables the installed musical instrument string to equalize to pitch faster than currently possible and enables a stringed musical instrument to remain in tune longer. The disclosed device is designed to fit easily against a tuning peg and to enable the musician to use the locking of the string to the peg technology without permanently changing the physical state of their musical instrument. Another purpose of the claimed subject matter is to provide a method and device that enables the musician to use the same strings he has always used, and not to have to buy special strings.

7 Claims, 5 Drawing Sheets

METHOD AND DEVICE FOR ATTACHING A MUSICAL INSTRUMENT STRING TO A MUSICAL INSTRUMENT TUNING PEG

CROSS-REFERENCE TO RELATED APPLICATIONS

The present application is related to and claims the benefit of the filing date of the following provisional application with a common inventor, which is hereby incorporated by reference:

U.S. Provisional Patent Application Ser. No. 60/600,422, filed Aug. 10, 2004, titled "Method and Device for Attaching a Musical Instrument String to a Musical Instrument Tuning Peg."

FIELD OF THE INVENTION

The present invention relates generally to stringed musical instruments, and more particularly to a method and device for attaching a musical instrument string to a musical instrument tuning peg.

BACKGROUND OF THE INVENTION

The usual mechanism incorporated on a guitar or other similar stringed musical instrument used to adjust string tension and bring a musical instrument into correct tune is referred to as a tuning machine. This tuning machine usually consists of a hand operated mechanism that rotates a tuning peg which is an integral part of the tuning machine. There is one tuning machine for each string and they are an integral part of the musical instrument. Normally the string to be tuned is threaded through a hole in the tuning peg and the tuning peg is rotated several times by means of a arm driven gear assembly to wrap the string at least several times around the tuning peg. The musician then continues to rotate the peg to tighten the string, and by this means achieves a correct pitch for each string. On other types of stringed musical instruments such as an autoharp, piano or harp, the tuning peg is usually not a part of a tuning machine, but simply the tuning peg set in the wood or other material of the musical instrument and the tuning peg is turned by a special tool made for this purpose.

This method of wrapping the string around the tuning peg is considered to have many problems including, but not limited to, the following:

To install a new string properly according to standard accepted practice requires wrapping the string around the tuning peg by turning the knob on the tuning machine. This wrapping of the string around the tuning peg requires skill, dexterity and is very time consuming.

It is difficult to get the string to wrap around the tuning peg evenly, which results in slack or loose windings that adversely affects tuning efficiency.

The part of the string that is wrapped around the tuning peg stretches and or slips and the string goes out of tune.

When turning the tuning machine to tune the string, not only is the musical or vibrating portion of the string being affected, but the windings or string wraps around the tuning peg are also affected. This is inefficient.

After the string is wrapped around the tuning peg and brought to the correct pitch there is a lag time when the musical instrument string has to be stretched quite a few times to equalize or remove slack or looseness in the wraps of the string around the tuning peg, and then the guitar has to be tuned to pitch again.

On guitars a special hand driven tuning machine knob winding tool is usually considered necessary to turn the tuning machine knob. Otherwise it takes a long time to wrap the string around the tuning peg by just turning the tuning peg by hand. Using this tool does not ensure that the string will be wrapped evenly and tightly.

Inventors have addressed these problems by developing special tuning machines that include various built-in clamping means. The musical instrument string is clamped and locked onto or into the tuning peg portion of these special tuning machines thereby avoiding the aforementioned wrappings of the string around the tuning peg. One advantage of these special locking style tuning machines is that it usually takes less than one complete turn of the tuning peg to bring the string to the correct pitch and using these locking tuning machines is considered to have the effect of keeping the guitar in tune longer. These special locking type tuning machines are complicated machines with gears, shafts, and bearings that are expensive to manufacture and are not even available for many of the large family of stringed musical instruments, especially acoustic stringed instruments.

These aforementioned special locking tuning machines are also usually only pre-installed on higher-end, modern and expensive guitars. If a musician wants to retrofit his guitar with these special tuning machines, he typically must incur the additional expense of taking the guitar to a repair shop to modify the guitar to accept the new clamping style tuning machines.

In addition for a vast number of electric guitars, acoustic guitars, mandolins, banjos cellos, violins, etc., there is no easy way to utilize the aforementioned locking the string to the tuning peg technology. For most of these instruments there are no locking style tuning machines available at all. On older guitars with antique or collector value, modifying the instrument to use a locking style tuning peg is not an option because modifying these antique type guitars decreases the value of the instrument. Since these special locking tuning machines are put on the guitar permanently, and are hard or impossible to change from one guitar to another the musician needs a separate set for each guitar. Therefore if a musician wants to use the clamping of the string to the tuning peg technology of attaching the string to the musical instrument tuning peg on the stringed instruments he already owns, there are no easy or cheap ways to do this.

What is needed is an apparatus that makes the tuning process faster, enables the string to maintain the tension that has been applied during the tuning operation for a longer period of time and addresses the other issues identified above.

BRIEF SUMMARY OF THE INVENTION

The musical string attachment device of the claimed subject matter enables a musician to simply and cheaply clamp and anchor a musical instrument string to a musical instrument tuning peg. The disclosed technology provides a method and device that enables the musician to take advantage of string locking technology cheaply and easily without having to purchase expensive clamping, locking style tuning machines or have to purchase a new instrument with string locking systems included. The claimed subject matter also provides a method and device that enables the musician to put on and take off the strings of a stringed musical instrument easily and rapidly which affords the musician the option of easily experimenting with various brands, materials, gauges, etc. of strings. The string attachment device also enables the installed musical instrument string to equalize pitch faster than currently possible with current practices by eliminating multiple string windings on a musical instrument tuning peg. The disclosed technology also enables a stringed musical instrument to remain in tune longer.

The disclosed device is designed to fit easily against a tuning peg and to enable the musician to use the locking of the string to the peg technology without permanently changing the physical state of their musical instrument. One purpose of the claimed subject matter is to provide a method and device that will make available string locking technology inexpensively for people who use acoustic guitars, mandolins, banjos, violins, cellos, or any other stringed instruments with tuning pegs that are designed to wrap the string around the peg. Another purpose of the claimed subject matter is to provide a method and device that enables the musician to use the same strings he has always used, and not to have to buy special strings.

This summary is not intended as a comprehensive description of the claimed subject matter but, rather, is intended to provide a brief overview of some of the functionality associated therewith. Other systems, methods, functionality, features and advantages of the invention are or will become apparent to one with skill in the art upon examination of the following figures and detailed description.

DETAILED DESCRIPTION OF THE INVENTION

Figure 1:
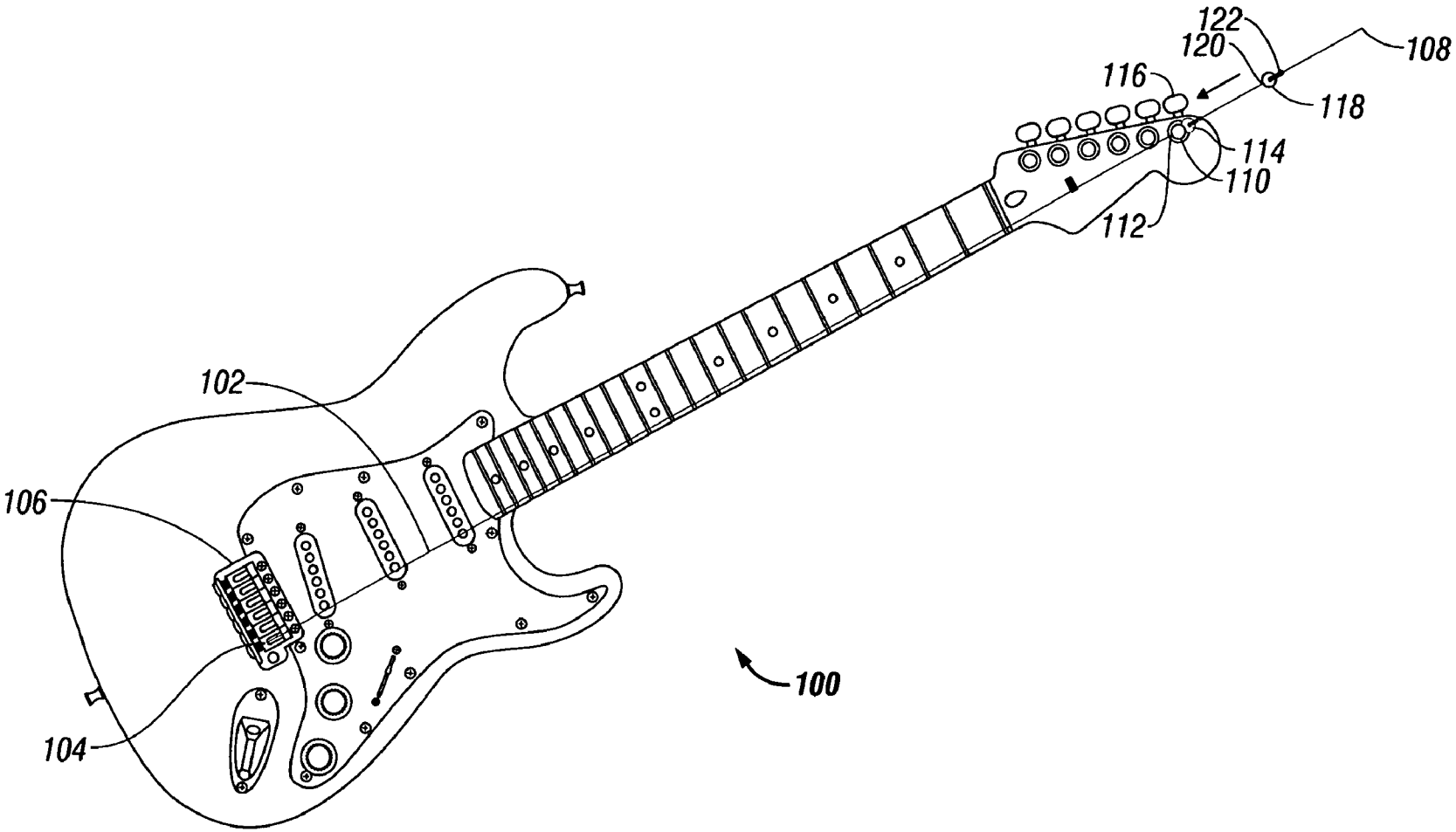
FIG. 1 is an illustration of an exemplary string instrument with the string tuning apparatus of the claimed subject matter in an unsecured position on a string.

The following description illustrates the claimed subject matter but, of course, should not be construed as in any way limiting its scope. Although described with particular reference to a guitar, the claimed subject matter can be implemented on any device in which a precise tension is required on a string. Those with skill in the musical and mechanical arts will recognize that the disclosed embodiments have relevance to a wide variety of musical instruments in addition to those described below.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The following reference numerals are employed throughout the figures. Like numerals in different figures refer to the same object, often from different perspectives.

| | | | |
|---|---|---|---|
| 100 | Guitar | 102 | Guitar string |
| 104 | String fixing end | 106 | Guitar string fixing end |
| 108 | String tuning end | 110 | Tuning peg |
| 112 | Tuning peg entrance aperture | 114 | Tuning peg exit aperture |
| 116 | Tuning peg rotating mechanism | 118 | String attachment mechanism (SAM) |
| 120 | SAM entrance aperture | 122 | SAM exit aperture |
| 124 | SAM main body | 126 | Guideway slot |
| 128 | SAM string passageway | 130 | Curved arm |
| 132 | Releasable actuating arm | 134 | Pivot pin |
| 136 | Ratchet teeth | 138 | Ratchet engaging teeth |
| 140 | Curved arm string passageway | 142 | tuning peg mating surface |
| 144 | SAM mating surface | 146 | Tuning peg string passageway |
| 148 | Cam member | 150 | Cam curve |

FIG. 1 illustrates a guitar 100 in the process of having a guitar string 102 installed. It should be understood that, although the following description uses a guitar for illustrative purposes, the claimed subject matter is equally applicable to any stringed musical instrument. Guitar string has a fixing end 104 and a tuning end 108. String 102 is attached to a string fixing end 106 of guitar 100 at string fixing end 104 of string 102. Tuning end 108 of string 102 passes through a tuning peg 110 affixed to guitar 100, entering tuning peg 110 at a tuning peg entrance aperture 112 and exiting a tuning peg exit aperture 114. It should be noted apertures 112 and 114 are interchangeable depending upon the orientation of tuning peg 110. In other words, entrance aperture 112 would become exit aperture 114 if, without a string inserted, tuning peg 110 is rotated one hundred eighty degrees (180°) and vice versa. At any particular point, prior to inserting string 102 through tuning peg 110, tuning peg entrance aperture 112 is the aperture facing string fixing end of guitar 106.

Tuning peg 110 is attached to a tuning peg rotation mechanism 116, which enables a musician to rotate tuning peg 110. The amount of rotation of tuning peg 110 determines the tension on string 102 and, therefore, the musical pitch of string 102. Those with skill in the musical arts should appreciate the manner in which a stringed instrument is tuned.

Inserted on string 102 in between tuning peg 110 and string tuning end 108 is a string attachment mechanism 118

(SAM), which, in this example, is spherical and illustrated in an unsecured, or open, position. String 102 enters SAM 118 at a SAM entrance aperture 120 and exits at a SAM exit aperture 122. SAM 118 and its relationship to string 102, tuning peg 110 and the various other elements of guitar 100 are described in more detail below in conjunction with FIGS. 2-6. In this figure, string 102 has been inserted through SAM 118 and SAM 118 is being slid down string 102 toward tuning peg 110. To secure string 102, SAM 118 is slid along string 102 until SAM 118 abuts tuning peg 110. The process for securing string 102 to tuning peg 110 and tuning guitar 100 is explained in more detail below in conjunction with FIG. 7.

Figure 2:
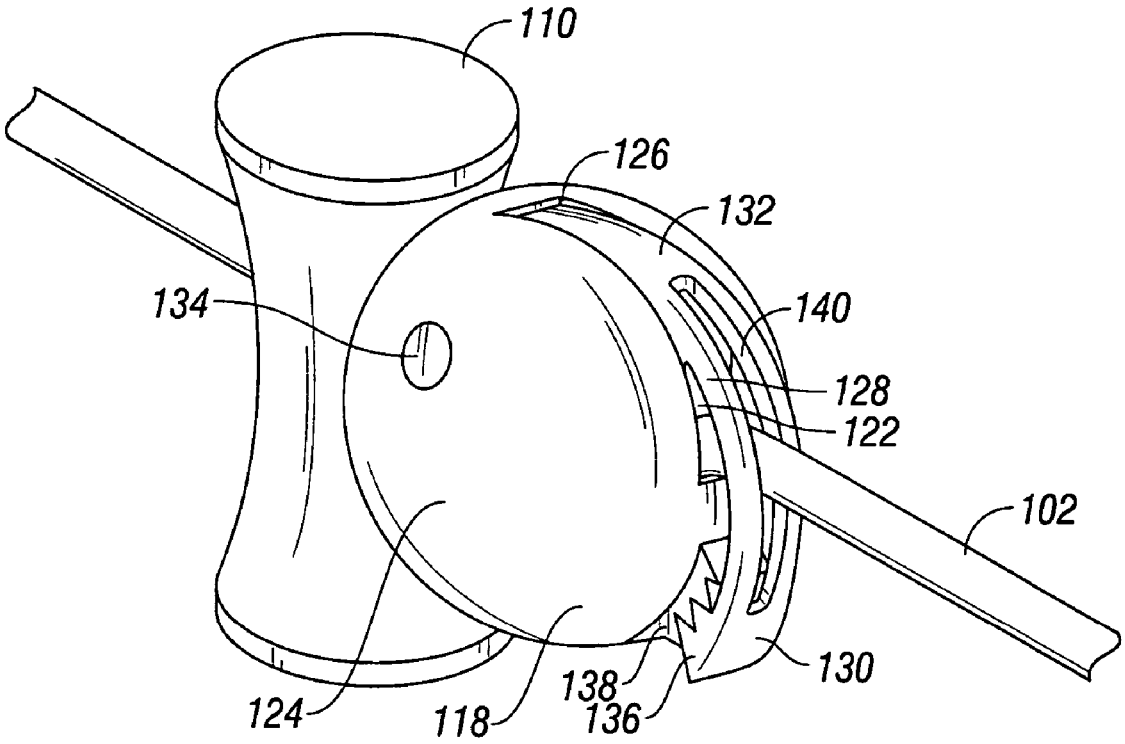
FIG. 2 is an illustration of the string attachment mechanism and tuning peg of FIG. 1 in more detail.

FIG. 2 is an illustration of tuning peg 110, guitar string 102 and SAM 118 of FIG. 1 in more detail. In this figure, SAM 118 is in a closed position and secured against tuning peg 110. SAM 118 opened and closed positions are explained in more detail below in conjunction with FIGS. 3-6. Also visible in FIG. 2 is string 102 exiting from SAM exit aperture 122 (FIG. 1).

SAM 118 includes a SAM main body 124, which in this example is spherical. It should be understood that many possible shapes for SAM main body 124 including, but not limited to, a barrel shape, an ovular shape, a cubical shape and compound shaped curves. As illustrated more clearly in FIGS. 5 and 6, SAM main body 124 is provided with a string passageway 128, which extends from SAM entrance aperture 120 (FIG. 1) along the longitudinal axis of SAM main body 124 to SAM exit aperture 122. A curved arm 130, which is part of a releasable actuating arm 132 is connected to SAM main body 124 by means of a pivot pin 134. Curved arm 130, actuating arm 132 and pivot pin 134 are described in more detail below in conjunction with FIGS. 3-6.

In this example, releasable actuating arm 132 is held into the closed position by means of ratchet teeth 136 on curved arm 130 that engage ratchet engaging teeth 138 on SAM main body 124. In a second embodiment, curved arm 130 does not include ratchet teeth 136 and SAM main body 124 does not include ratchet engaging teeth 138. In the second embodiment, releasable actuating arm 132 is held into a closed position by means of tension on string 102 from the direction of string fixing end 104 and friction and compression among a cam member 148 (see FIGS. 5 and 6) of releasable actuating arm 132, string 102 and cam curve 150 (see FIGS. 5 and 6) of SAM main body 124.

Releasable actuating arm 132 includes a curved arm string passageway 140 that enables string 102 to pass through curved arm 130 when releasable actuating arm 132 is in both an open and closed position. In this example, curved arm string passageway 140 is illustrated as an oval opening in curved arm 130. In another embodiment, curved arm string passageway 140 may be a notch that extends from the upper portion of curved arm 130 through the bottom of curved arm 130, thus in effect turning curved arm 130 into two (2) parallel arms or prongs.

Figure 3:
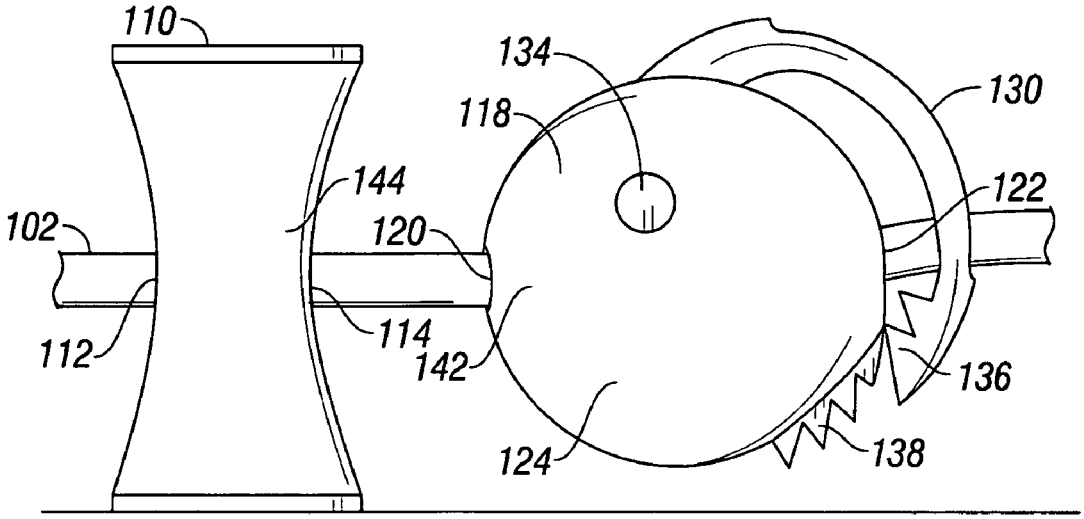
FIG. 3 is an illustration of the string attachment mechanism and tuning peg of FIGS. 1-2 from a different perspective.

FIG. 3 is an illustration of tuning peg 110, guitar string 102 and SAM 118 of FIG. 1 from a different perspective. FIG. 3 illustrates the positions of tuning peg entrance aperture 112 (FIG. 1), tuning peg exit aperture 114 (FIG. 1), SAM entrance aperture 120 (FIG. 1) and SAM exit aperture 122 (FIGS. 1 and 2). String 102 is illustrated passing through tuning peg 110, entering at tuning peg entrance aperture 112 and exiting at tuning peg exit aperture 114 and passing through SAM 118, entering at SAM entrance aperture 120 and exiting at SAM exit aperture 122. In this illustration, SAM 118 is in an open position as evidenced by the fact that curved arm 130 (FIG. 2) is not secured to SAM main body 124 (FIG. 2) by means of ratchet teeth 136 (FIG. 2) being engaged with ratchet engaging teeth 138 (FIG. 2). In the illustrated open position, string 102 is able to slide freely through SAM string passageway 128 (see FIGS. 5-6). A portion of curved arm 130 pivots through SAM 118 in a guideway slot 126.

When SAM 118 is correctly positioned to secure string 102 with respect to tuning peg 110 (see FIGS. 4 and 6), a mating surface on SAM main body 124, or the tuning peg mating surface 142, fits against a mating surface on the tuning peg, or the SAM mating surface 144. Tuning peg mating surface 142 is positioned on the same side of SAM main body 124 as SAM entrance aperture 120. SAM-mating surface 144 is on the same side of tuning peg 110 as tuning peg exit aperture 114.

Figure 4:
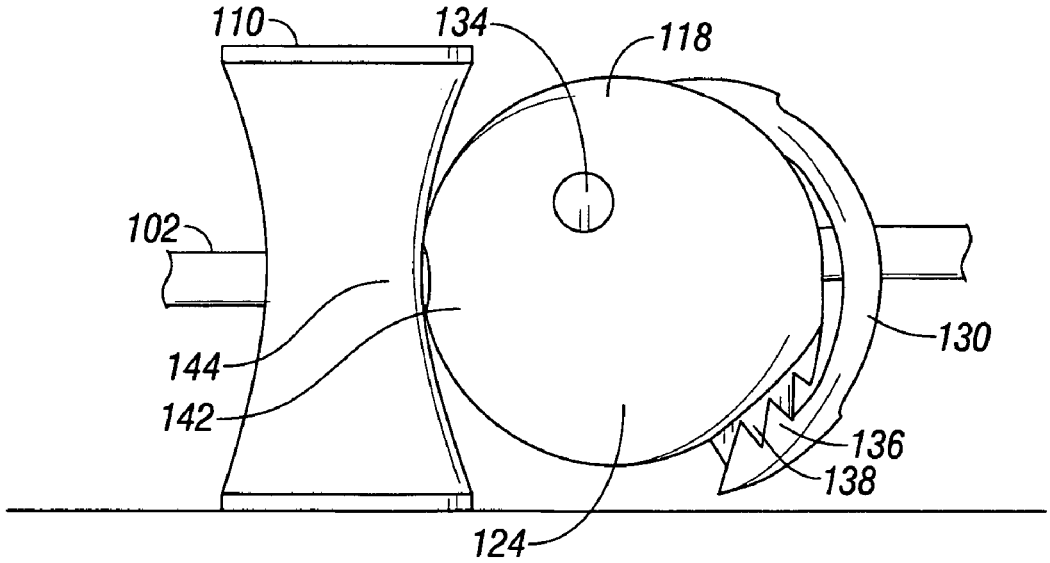
FIG. 4 is an illustration of the string attachment mechanism of FIGS. 1-3 in a secured position against the tuning peg of FIGS. 1-3.

FIG. 4 is a side view of tuning peg 110, guitar string 102 and SAM 118 of FIG. 3 illustrated with SAM 118 in a closed position. Also illustrated and labeled are SAM main body 124, curved arm 130, pivot pin 134 ratchet teeth 136, ratchet engaging teeth 138, tuning peg mating surface 142 and SAM mating surface 144. In the closed string-securing position, string 102 is not free to slide freely through SAM string passageway 128 (see FIGS. 5-6). The closed position is characterized by curved arm 130 pushed down toward SAM main body 124 such that ratchet teeth 136 are engaged with ratchet engaging teeth 138. Further, tuning peg mating surface 142 abuts SAM mating surface 144. The manner in which string 102 is prevented from sliding freely through SAM string passageway 128 when SAM 118 is in the closed position and thus securing string 102 with respect to tuning peg 110 is explained in more detail below in conjunction with FIG. 6.

Figure 5:
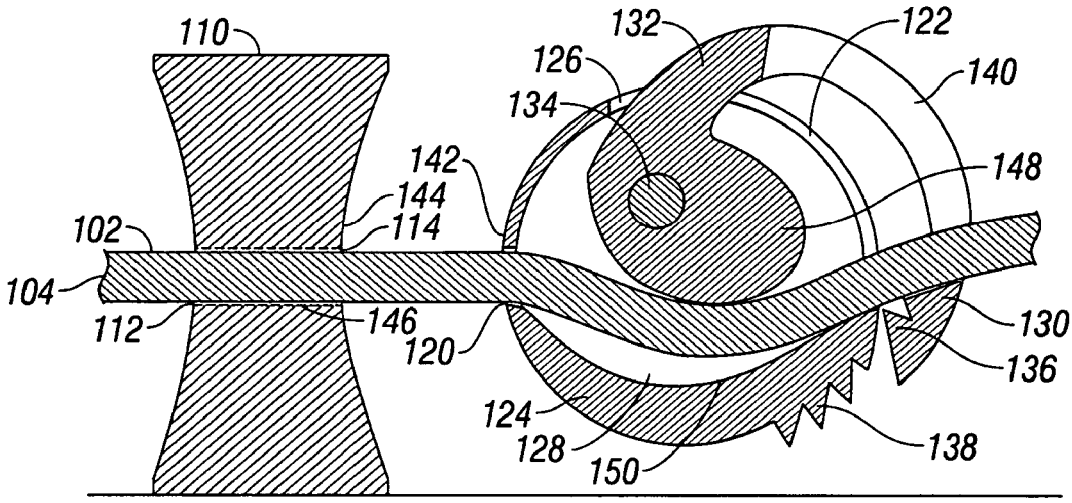
FIG. 5 is a cut-away illustration of the string attachment mechanism and tuning peg of FIGS. 1-4 in an unsecured position.

FIG. 5 is a cross-sectional view of SAM 118 and tuning peg 110 of FIGS. 1-4 in an unsecured, or open, position. Illustrated and labeled in FIG. 5 are string 102, tuning peg 110, tuning peg entrance aperture 112, tuning peg exit aperture 114, guideway slot 126, SAM string passageway 128, curved arm 130, releasable actuating arm 132, pivot pin 134, ratchet teeth 136, ratchet engaging teeth 138, curved arm string passageway 140, tuning peg mating surface 142 and SAM mating surface 144, all described above in conjunction with FIGS. 1-4.

In addition, a tuning peg string passageway 146, a cam member 148 and a cam curve 150 are visible. Releasable actuating arm 132 is mounted on pivot pin 134, which projects laterally across guideway slot 126. Cam member 148 is part of releasable actuating arm 132 and secures string 102 within SAM 118 by pressing string 102 against cam curve 150 of SAM string passageway 128 when SAM 118 in a closed position. Although illustrated with a curved surface, cam member 148 could also be a wedge shape. Releasable actuating arm 132 is integrally connected to cam member 148 and extends upward through guideway slot 126 and outside of SAM main body 124. Curved arm portion 130 of releasable actuating arm 132 arcs downward following around the outside curve of SAM main body 124.

In FIG. 5, SAM 118 is in an open position and not engaged with tuning peg 110, which as explained above in conjunction with FIG. 3, means that string 102 is able to pass freely through SAM string passageway 128.

Figure 6:
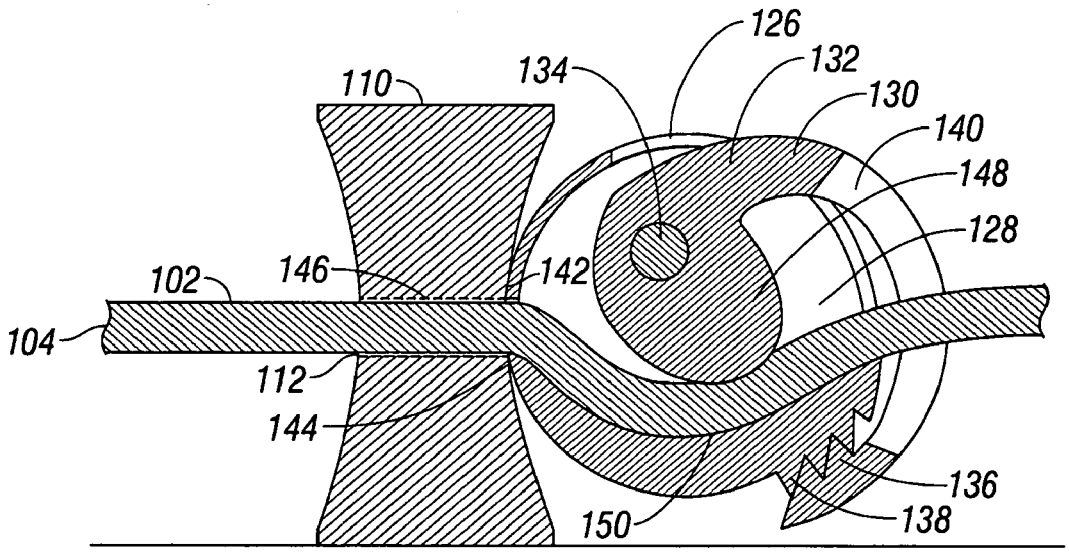
FIG. 6 is a cut-away illustration of the string attachment mechanism and tuning peg of FIGS. 1-5 in a secured position.

FIG. 6 is a cut-away illustration of the SAM 118 and tuning peg 110 of FIGS. 1-5 in a secured, or closed, position. Like FIG. 5, FIG. 6 illustrates and labels string 102, tuning peg 110, tuning peg entrance aperture 112, guideway slot 126, SAM string passageway 128, curved arm 130, releasable actuating arm 132, pivot pin 134, ratchet teeth 136, ratchet engaging teeth 138, curved arm string passageway 140, tuning peg mating surface 142 and SAM mating surface 144, all described above in conjunction with FIGS. 1-5. In addition, tuning peg string passageway 146 (FIG. 5) and cam member 148 (FIG. 5) are visible.

In the closed position, cam member 148 secures string 102 within SAM 118 by pressing string 102 against a cam curve 150 of SAM string passageway 128. Cam member 148 and cam curve 150 are shaped so that as curved arm 130 is pressed down in the direction of SAM main body 124 the space between cam member 148 and cam curve 150 gets smaller. In this manner, strings of varying sizes can be secured within SAM 118.

In FIG. 6, SAM 118 is in a closed position, which, as explained above in conjunction with FIG. 4, means that string 102 is not able to pass freely through SAM string passageway 128 because string 102 is pinched in between cam member 148 and cam curve 150 of SAM main body 124. In the illustrated embodiment, curved arm 130, releasable actuating arm 132 and cam member are fixed into a closed orientation with respect to cam curve 150 by means a combination of tension on string 102 and an engagement of ratchet teeth 136 and ratchet engaging teeth 138. As explained above in conjunction with FIG. 2, in a second embodiment, curved arm 130 does not include ratchet teeth 136 and SAM main body 124 does not include ratchet engaging teeth 138. In the second embodiment, releasable actuating arm 132 is held into a closed position by means of tension on string 102 from the direction of string fixing end 104 and friction and compression among cam member 148 of releasable actuating arm 132, string 102 and SAM main body 124.

Figure 7:
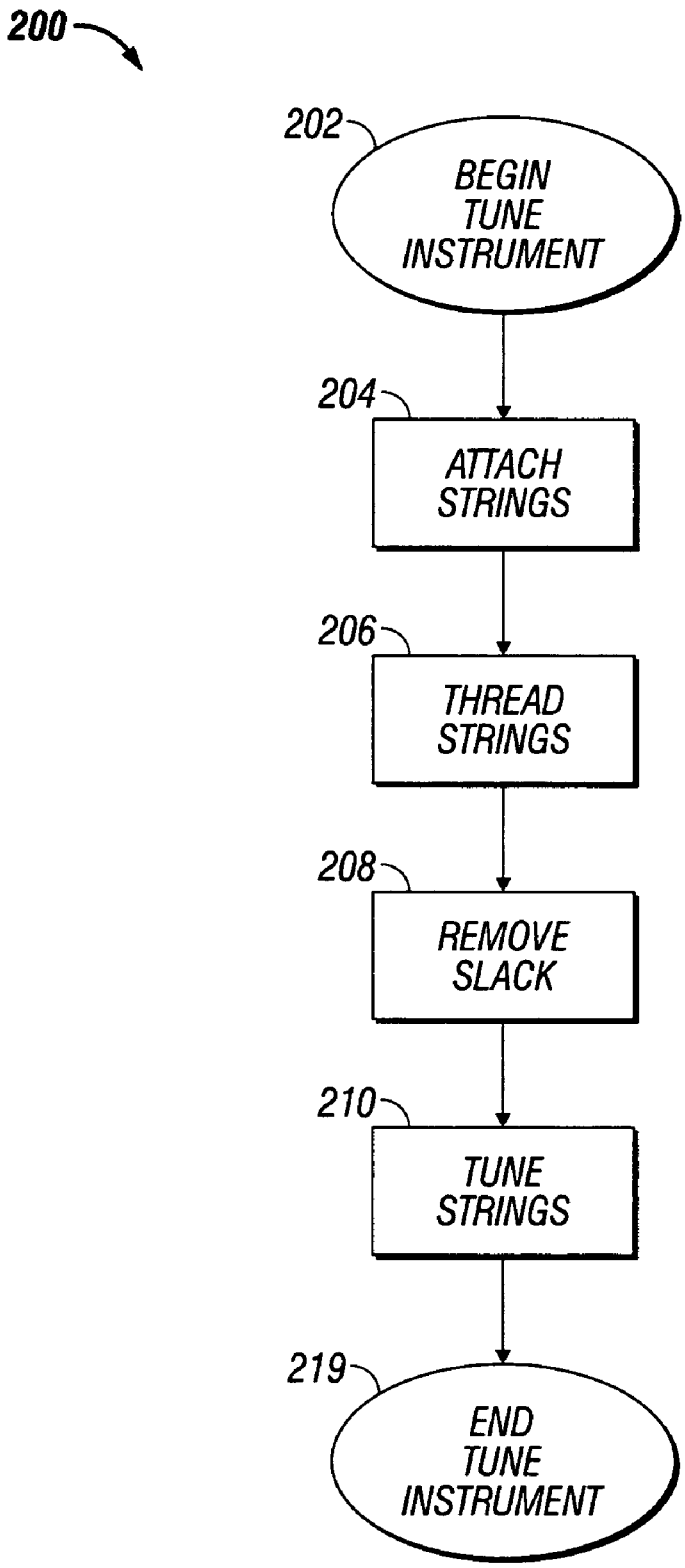
FIG. 7 is a flowchart of an exemplary string instrument tuning process that employs the claimed subject matter.

FIG. 7 is a flowchart of an exemplary String Instrument Tuning process 200 that employs the claimed subject matter. SAM 118, string 102, guitar 100 and the other elements introduced in conjunction with FIGS. 1-6 are employed together to install and tune strings of guitar 100 by means of the following technique.

Stringed Instrument Tuning process 200 starts in a "Begin Tune Instrument" block 202 and proceeds immediately to an "Attach Strings" block 204. During block 204, fixing end 104 of string 102 is attached to string fixing end 106 of guitar 100 in a manner that should be familiar to those with skill in the musical arts. Block 204 is then executed on any other strings of guitar 100. Although process 200 is described with each block applied sequentially to each string of a particular stringed instrument, process 200 may be executed such that one or more blocks is executed on multiple strings before the next block is executed. For the sake of simplicity, the following blocks are described with respect only to string 102.

During a "Thread Strings" block 206, tuning end 108 of string 102 is passed through tuning peg 110, entering tuning peg 110 at tuning peg entrance aperture 112 and exiting at tuning peg exit aperture 114. Then, tuning end 108 of string 102 is passed through SAM entrance aperture 120, SAM string passageway 128, SAM exit aperture 122 and curved arm string passageway 140 of releasable actuating arm 132 of SAM 118, as shown in a string accepting position as in FIGS. 3 and 5. The string accepting position of SAM 118 is achieved by lifting releasable actuating arm 132, which causes cam member 148 to rotate axially around pivot pin 134 providing space for tuning end 108 of string 102 to pass easily through SAM 118.

During a "Remove Slack" block 208, string 102 is pulled from tuning end 108 to remove slack and create tension in string 102 with one hand, while at the same time with the other hand applying pressure to SAM 118 to cause SAM 118 to slide easily along string 102 towards tuning peg 110. While applying pressure against SAM main body 124 at the curved arm 130 of releasable actuating arm 132, tuning peg mating surface 142 contacts SAM mating surface 144. Tuning peg 110, which is an opposing body, and a continuation of the aforementioned applied pressure against curved arm portion 130 of releasable actuating arm 132 causes cam member 148 to rotate axially around pivot pin 134. In this manner, cam member 148 exerts a clamping action upon string 102, which brings about the state of string 102 being clamped and locked tightly with respect to SAM 118 and tuning peg 110, as shown in detail in FIGS. 2, 4 and 6.

During a "Tune Strings" block 210, once all the strings of guitar 100 are attached as described above during blocks 204-208, guitar 100 is tuned using tuning peg rotating mechanisms 116 (FIG. 1) in a process that should be familiar to those with skill in the musical arts. Finally, in an "End Tune Instrument" block 219, String Instrument Tuning process 200 is complete. The disclosed subject matter enables a musical instrument string to be tuned to proper pitch with less turning of tuning peg rotating mechanism 116. In other words, multiple windings around tuning peg 110 are eliminated.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. It is to be recognized that any material suitable for the construction and manufacture of the device can be used. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A device for securing a musical instrument string to a musical instrument tuning peg, comprising:

a clamping mechanism configured to be affixed to a musical instrument string and be changeable between an open position and a closed position; the clamping mechanism comprising:

a tuning peg mating surface; and a string passageway through the tuning peg mating surface;

wherein, after passing through a tuning peg of a musical instrument, the musical instrument string passes through the string passageway when the clamping mechanism is in the open position; and wherein the musical instrument string is prevented from passing back out of the tuning peg when the string is positioned within the string passageway, the clamping mechanism is in a closed position and the tuning peg mating surface abuts the tuning peg.

2. The device of claim 1, wherein the tuning peg mating surface is optimized to fit stably against the tuning peg.

3. The device of claim 1, wherein the clamping mechanism is constructed from a single piece of moldable material.

4. The device of claim 1, wherein the clamping mechanism is releasable so that the string can be removed from the musical instrument.

5. The device of claim 1, wherein tension on the musical instrument string pulls the tuning peg mating surface against the tuning peg.

6. The device of claim 1, wherein the tuning peg mating surface is generally spherical.

7. The device of claim 6, wherein the passageway is centered in the tuning peg mating surface.

* * * * *